United States Patent [19]

Kim et al.

[11] Patent Number: 4,679,407

[45] Date of Patent: Jul. 14, 1987

[54] BEVERAGE CONTAINER WITH ENCLOSED COOLING MEANS

[76] Inventors: Ho K. Kim, 162-1, Hongjae 1-dong, Sudaemun-ku, Seoul; Seung E. Choi, Samho Garden Mansion Apartment, Block 8, Rm 808. 444-1, Banpo 1-dong, Kangnam-ku, Seoul, both of Rep. of Korea

[21] Appl. No.: 807,444

[22] Filed: Dec. 10, 1985

[51] Int. Cl.[4] ..... F25D 3/10

[52] U.S. Cl. ..... 62/294; 62/4; 62/457

[58] Field of Search ..... 62/4, 294, 457

[56] References Cited

U.S. PATENT DOCUMENTS

| | | | |
|---|---|---|---|
| 3,309,890 | 3/1967 | Barnett et al. | 62/4 X |
| 3,494,141 | 2/1970 | Irwin et al. | 62/457 X |
| 3,494,143 | 2/1970 | Barnett et al. | 62/294 |
| 3,525,236 | 8/1970 | Solhkhah | 62/457 X |
| 3,636,726 | 1/1972 | Rosenfeld et al. | 62/457 X |
| 3,919,856 | 11/1975 | Beck | 62/294 X |

*Primary Examiner*—Lloyd L. King

*Attorney, Agent, or Firm*—Birch, Stewart, Kolasch & Birch

[57] ABSTRACT

The present invention relates to a beverage container which contains an enclosed pressurized liquid cooling agent whereby when the container is opened the pressurized liquid cooling agents immediately acts to cool the contents of the container.

4 Claims, 2 Drawing Figures

BEVERAGE CONTAINER WITH ENCLOSED COOLING MEANS

BACKGROUND OF THE INVENTION

The present invention relates to a beverage container with an enclosed cooling means and more particularly to an improved beverage container wherein upon opening the container the cooling means automatically acts to cool the contents of the container.

In order to provide cold beverages for use at a picnic or beach area, it is necessary to also provide portable ice chests or ice bags to cool the beverages. However, it is very inconvenient and uncomfortable to carry and prepare such heavy ice containers or ice bags.

SUMMARY AND OBJECTS OF THE INVENTION

Accordingly, it is an object of the present invention to provide a beverage container which has an enclosed cooling means which can be used for cooling a beverage such as soft drinks, milk, juice and the like.

Another object of the present invention is to provide a beverage container with an enclosed cooling member which automatically acts to cool the contents of the container when the container is opened.

Still another object of the present invention is to provide an improved beverage container with an enclosed cooling means which comprises a cooling tank containing condensed cooling agents disposed at bottom of the container and a bent tube which communicates with the cooling chamber.

Yet another object of the present invention is to provide a beverage container with enclosed cooling means which is very easy and simple to use.

It is a further object of the present invention to provide a container having an enclosed cooling member which is convenient and comfortable to carry as compared with conventional ice chests.

Other objects and further scope of applicability of the present invention will become apparent from the detailed description given hereinafter. It should be understood, however, that the detailed description while indicating preferred embodiments of the invention is given by way of illustration only, since various changes and modifications within the spirit and scope of the invention will become apparent to those skilled in the art from this detailed description.

Briefly described, the present invention comprises a beverage container provided with an enclosed cooling member which automatically acts to immediately cool the contents of the container when it is opened by pulling back the opening tab.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 2:
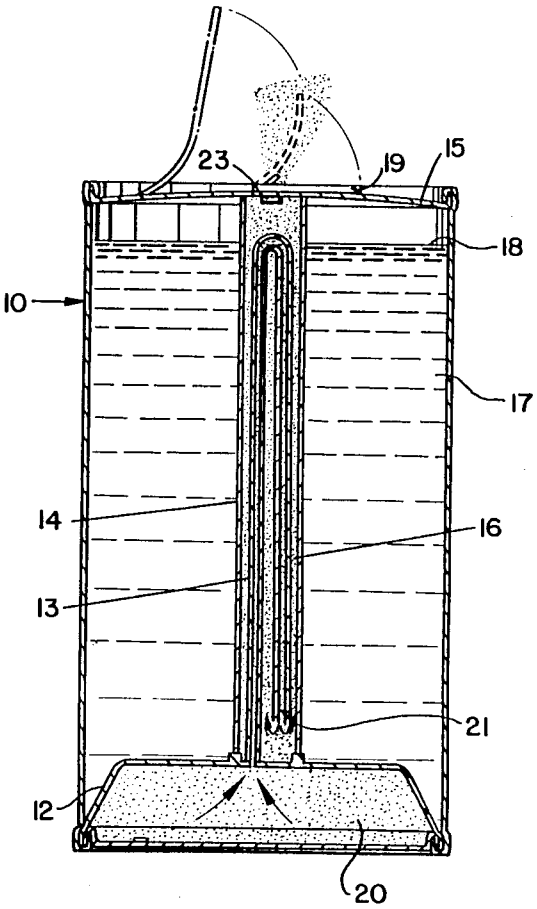
FIG. 2 is a cross-sectional view of a beverage container with an enclosed cooling means.
Figure 1:
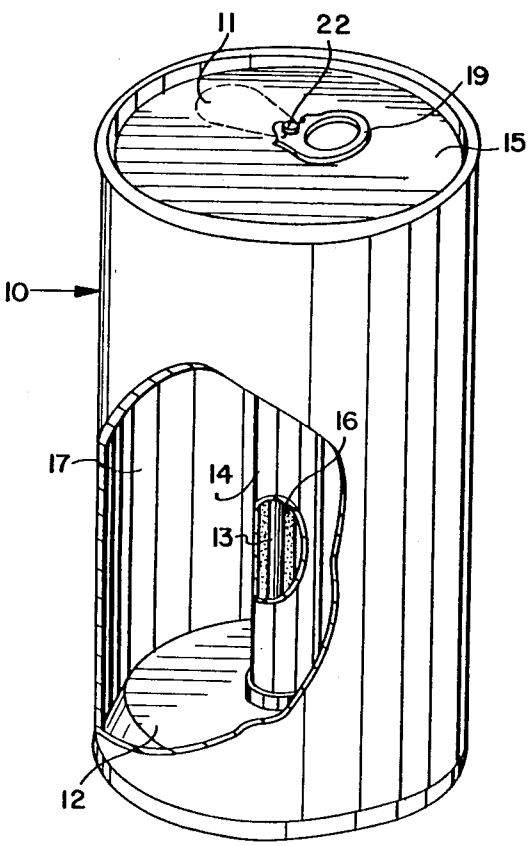
FIG. 1 is a perspective view of the beverage container with an enclosed cooling member according to the present invention and illustrating and a portion of a centrally desposed tube with a part of its surface broken away.

Referring now in detail to the drawing for the purpose of illustrating the present invention, the beverage container 10 of the present invention, as shown in FIGS. 1 and 2, comprises a top wall 15, an opening tab 19, a removable panel 11, a cooling tank 12 disposed at the bottom of the container 10 and a tube 14 disposed at a central portion of the container which includes a bent pipe 13 disposed in a cooling chamber 16. The front portion of the removable panel 11 is attached to the opening tab 19 by a rivet 22 which extends from the top wall 15 of the container 10. The cooling tank 12 contains a pressurized liquid cooling agent 20 such as liquid ammonia gas, or the like. The bent pipe 13 is disposed within the central tube 14 and is provided with a small size aperture 21 which communicates with the cooling chamber 16. The container 10 is filled with its contents 17 to a level 18 which leaves a space at the upper portion of the container 10. The rivet 22 is disposed at the central portion of the lid portion adjacent to the top of the tube 14 so that an aperture or an outlet 23 is immediately provided when the pull-top opener 19 is pulled by the user to a partially open position. The liquid cooling agent 20 immediately expands from the small size aperture 21 disposed at the end of pipe 13, said expansions immediately cooling the contents of the container. Thus, the cooling chamber 16 of the tube 14 is provided with a lower temperature sufficient to cool the contents 17 of the container 10. After the expansion of the liquid cooling agent 20 is completed and the contents of the container is completely cooled, the opener 19 is then pulled to removed the removable panel 11 and expose the contents of the container for drinking. The container of the present invention is very simple and easy to use and eliminates the need for ice chests for cooling a drink.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A beverage container with an enclosed cooling system which comprises:

a beverage container provided with a container top and containing a cooling system disposed within said container, said cooling systems comprising, a cooling tank adapted to contain a pressurized liquid cooling agent and disposed within said container in the lower portion thereof, a conduit means extending through the container from the cooling tank to the top of the container, and defining a chamber therein, and pipe means disposed within the conduit means and having a serpentine configuration, said pipe means communicating at one end with the cooling tank and at the other end with the chamber of the conduit means, said other end having a reduced-size portion, said container top being provided with a removable panel portion having an opener attached to the outside surface thereof, whereby, upon the initial opening of the removable panel, the chamber of the conduit means is exposed to the environment and the pressurized liquid cooling agent immediately expands from the reduced-size end portion disposed at the lower end portion of the conduit means to cool the contents of the container.

2. The beverage container with an enclosed cooling system of claim 1 wherein the front portion of the removable panel is attached to the opening tab by a rivet.

3. The beverage container with an enclosed cooling system of claim 2 wherein the rivet is disposed at a central portion of the lid portion adjacent to the top of the conduit means for initially exposing one the chamber of the conduit means to the environment.

4. The beverage container with an enclosed cooling system of claim 1 wherein the pressurized liquid cooling agent is liquid ammonia gas.

* * * * *